US005135436A

United States Patent [19]

Levy et al.

[11] Patent Number: 5,135,436

[45] Date of Patent: Aug. 4, 1992

[54] PERSONALIZED AIR CONDITIONING SYSTEM

[75] Inventors: Hans F. Levy; Peter G. Betz, both of Cherry Hill, N.J.

[73] Assignee: Argon Associates, L. P., Cherry Hill, N.J.

[21] Appl. No.: 577,950

[22] Filed: Oct. 12, 1990

Related U.S. Application Data

[63] Continuation-in-part of Ser. No. 488,922, Mar. 5, 1990.

[51] Int. Cl.[5] ..... F24F 5/00

[52] U.S. Cl. ..... 454/306; 454/322

[58] Field of Search ..... 237/46, 50, 53, 49; 98/34.5, 34.6, 31, 31.5, 31.6, 32; 454/306, 322

[56] References Cited

U.S. PATENT DOCUMENTS

| | | | |
|---|---|---|---|
| 1,455,846 | 5/1923 | Lewis . | |
| 2,140,829 | 12/1938 | Child | 62/129 |
| 2,434,847 | 1/1948 | Hagen | 98/38 |
| 2,835,186 | 5/1958 | Goldsmith | 98/33 |
| 3,156,233 | 11/1964 | O'Connell | 126/110 |
| 4,135,440 | 1/1979 | Schmidt et al. | 98/31 |
| 4,250,800 | 2/1981 | Brockmeyer | 98/40 C |
| 4,351,475 | 9/1982 | Hudson | 237/46 |
| 4,353,411 | 10/1982 | Harter et al. | 165/48 R |
| 4,378,727 | 4/1983 | Doss | 98/33 R |
| 4,531,454 | 7/1985 | Spoormaker | 98/31.6 |
| 4,646,966 | 3/1987 | Nussbaum | 237/49 |
| 4,775,001 | 10/1988 | Ward et al. | 165/22 |

FOREIGN PATENT DOCUMENTS

| | | |
|---|---|---|
| 2145744 | 7/1973 | Fed. Rep. of Germany . |
| 2407448 | 8/1975 | Fed. Rep. of Germany . |
| 2719570 | 11/1978 | Fed. Rep. of Germany . |
| 2938702 | 4/1981 | Fed. Rep. of Germany . |
| 61-11535 | 1/1986 | Japan . |

*Primary Examiner*—Henry A. Bennet

*Attorney, Agent, or Firm*—Panitch Schwarze Jacobs & Nadel

[57] ABSTRACT

An air conditioning system comprising a personal air terminal extending upwardly from a floor through a surface for supplying conditioned air to an area. The personal air terminal includes a first wall integrally connected to a second wall to form the personal air terminal. The first and second walls each have an upper and a lower portion. The first and second walls taper inwardly from their lower portions to their upper portions for allowing air to readily flow therebetween. The first and second wall are in engagement with and surround an opening in the floor. A pair of air outlet registers are integral with one of the first and second walls and elevated a predetermined distance from the floor for allowing air flowing between the first and second walls to flow to an area surrounding the personal air terminal. A fan unit moves conditioned air from the second side of the floor through the opening, between the first and second walls and through the registers to the surrounding area.

18 Claims, 9 Drawing Sheets 62
63
56
55
64
64
58
57
60
60
2
2
28
12
61
27
27
27
49
45
46
48
37
50
47
30
34
32
31
40
37
35
39
43
36
38
42
33
70
41
16
10
26
19
15
15
18
25
20
21
22
17

PERSONALIZED AIR CONDITIONING SYSTEM

CROSS REFERENCE TO RELATED APPLICATION

This application is a continuation-in-part of co-pending U.S. patent application Ser. No. 488,922, filed on Mar. 5, 1990.

FIELD OF THE INVENTION

The present invention relates to heating and air conditioning and, more particularly, to a personal air terminal extending upwardly from a floor for supplying conditioned air to a surrounding area.

BACKGROUND OF THE INVENTION

In the field of heating and air conditioning, there are known problems causing discomfort to occupants, inefficiencies resulting in excessive cost to building operators, and inconveniences in tho operation and control of present systems.

For example, central building control of temperature, air flow, humidity, and the like, or even individual room controls, usually leaves many persons in the building or within the room uncomfortable or dissatisfied with the condition of their particular work environment. Different people have differing personal comfort needs. Also, different locations in a building, or even in a single room, are not satisfactorily cooled or heated, giving rise to complaints about discomfort and illness, resulting in potential absenteeism, sickness and loss of productivity.

Further, conventional air conditioning systems generally require expensive duct work, usually in floors or ceilings, or both, which cause unnecessary heating and cooling of unused space, particularly space surrounding the duct work and space above the head level of the occupants, for example, the upper four feet of space in a room having a twelve foot ceiling. Such duct work also imposes a substantial energy demand for movement of conditioned air through the ducts and presents difficulties in cleaning.

Prior systems with fixed floor or wall mounted air outlet grilles limited the location of furniture and equipment in a manner which would not block air flow. Such prior systems also created areas of complaint or discomfort caused by high or low air velocity and/or extreme high or low temperature depending upon the proximity of the air outlet grilles. Air outlet grilles frequently needed to be moved to accommodate changes in air conditioning load or rearrangement of the workspace.

Consequently, in the field of heating and air conditioning, there exists a need for providing a flow of conditioned air directly to or near a person seated at a desk or work area, as well as to occupants of the surrounding area. More particularly, there exists a need for a desk or work area wherein the occupant can individually obtain and control the amount of conditioned air supplied proximate the desk or work area for maximizing the comfort, well-being, health and productivity of the worker, while maintaining a desirable flow of conditioned air to the surrounding area.

Personal air terminals disclosed in the prior art are not readily adaptable to receive air from underneath the floor. Such personal air terminals are generally uniform in cross section and, therefore, frictionally impede the flow of air therethrough. Because the flow of air is impeded, such systems are inefficient and give rise to greater operating costs. Hence, a need exists for supplying conditioned air to an area proximate a desk or work area from underneath the floor in an efficient manner by facilitating flow of air through the personal air terminal.

To remedy the problems inherent in existing personal air terminals, the present invention provides a personal air terminal which telescopes inwardly to facilitate flow of air therethrough and thereby increase the efficiency of the system. The personal air terminal of the present invention allows an occupant proximate the air terminal to individually control the conditioned air flowing into his, or her immediate environment without significantly decreasing the flow of conditioned air to the surrounding area. Therefore, the personal air terminal of the present invention results in considerable savings in the form of increased worker comfort and productivity, improved worker health and decreased utility costs.

SUMMARY OF THE INVENTION

Briefly stated, the present invention comprises a personal air terminal extending upwardly from a floor through a surface for supplying conditioned air to an area. The personal air terminal includes a first wall integrally connected to a second wall to form the personal air terminal. The first and second walls each have upper and lower portions. The lower portion of the first wall is spaced apart from the lower portion of the second wall by a first predetermined distance to define a first air flow area therebetween. The upper portion of the first wall is spaced apart from the upper portion of the second wall by a second predetermined distance to define a second air flow area therebetween. The first predetermined distance is greater than the second predetermined distance. The first and second walls taper inwardly from the lower portions of the first and second walls to the upper portions of the first and second walls for allowing air to readily flow therebetween. The lower portions of the first and second walls are in engagement with the floor and surround an opening in the floor. Air outlet means integral with one of the first or second walls and elevated a predetermined distance from the floor are provided for allowing air flowing through the first and second air flow areas to flow therethrough to an area surrounding the personal air terminal. Air moving means moves conditioned air from a second side of the floor to the first and second air flow areas whereby air flows from the second side of the floor through the opening into the first and second air flow areas and through the air outlet means to the surrounding area.

BRIEF DESCRIPTION OF THE DRAWINGS

The foregoing summary, as well as the following detailed description of preferred embodiments, is better understood when read in conjunction with the appended drawings. For the purpose of illustrating the invention, there is shown in the drawings embodiments which are presently preferred, it being understood, however, that the invention is not limited to the specific methods and instrumentalities disclosed. In the drawings.

DESCRIPTION OF PREFERRED EMBODIMENTS

Figure 1:
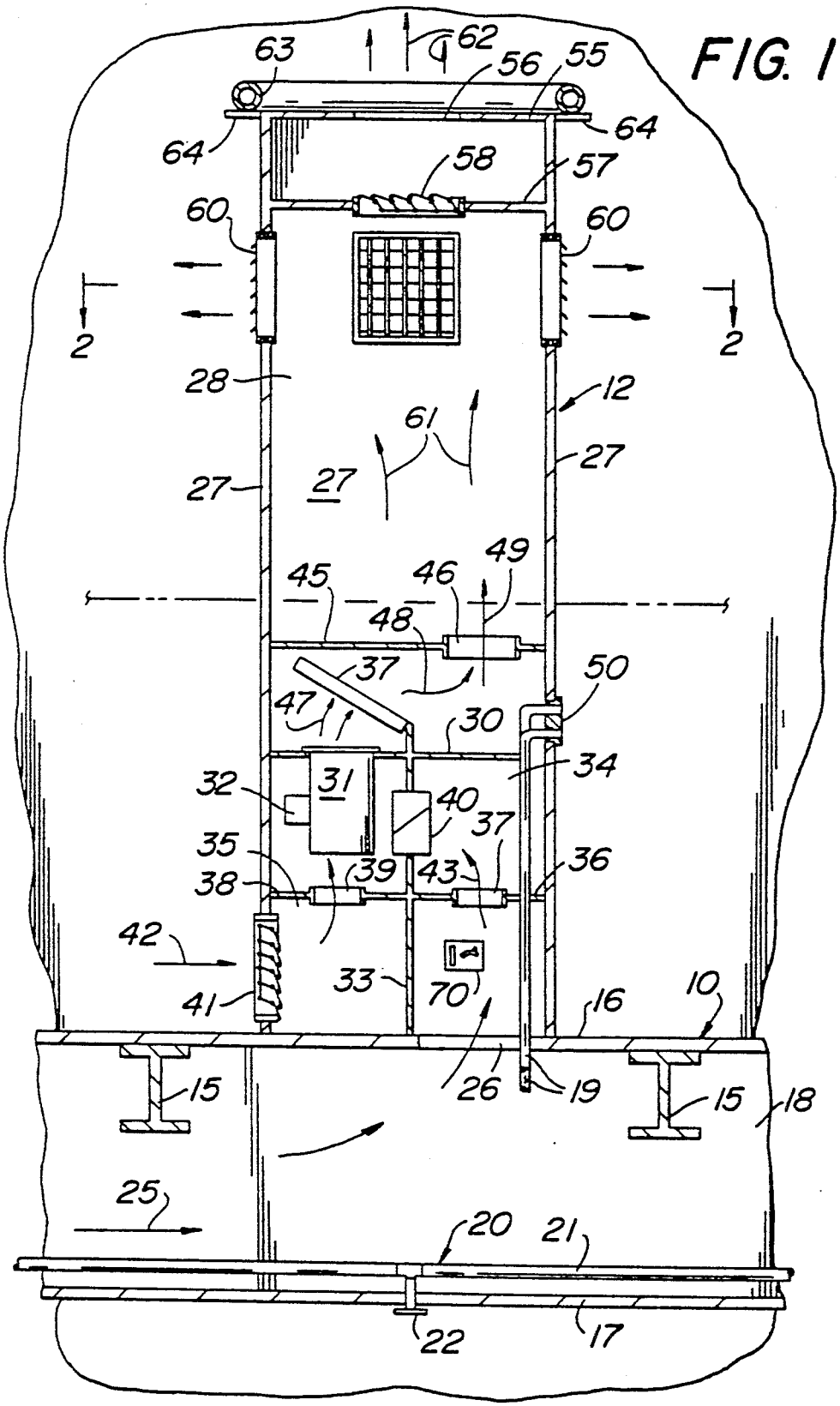
FIG. 1 is a sectional elevational view showing a personalized environmental control station in accordance with the present invention.

Certain terminology is used in the following description for convenience only and is not limiting. The words "right," "left," "lower," and "upper" designate directions in the drawings to which reference is made. The words "inwardly" and "outwardly" refer to directions toward and away from, respectively, the geometric center of the personalized air conditioning system and designated parts thereof. The terminology includes the words above specifically mentioned, derivatives thereof and words of similar import.

The word "plenum" is used herein as commonly used by those skilled in the art, to mean a relatively large enclosure or chamber to which may be connected a plurality of small ducts or conduits.

Figure 2:
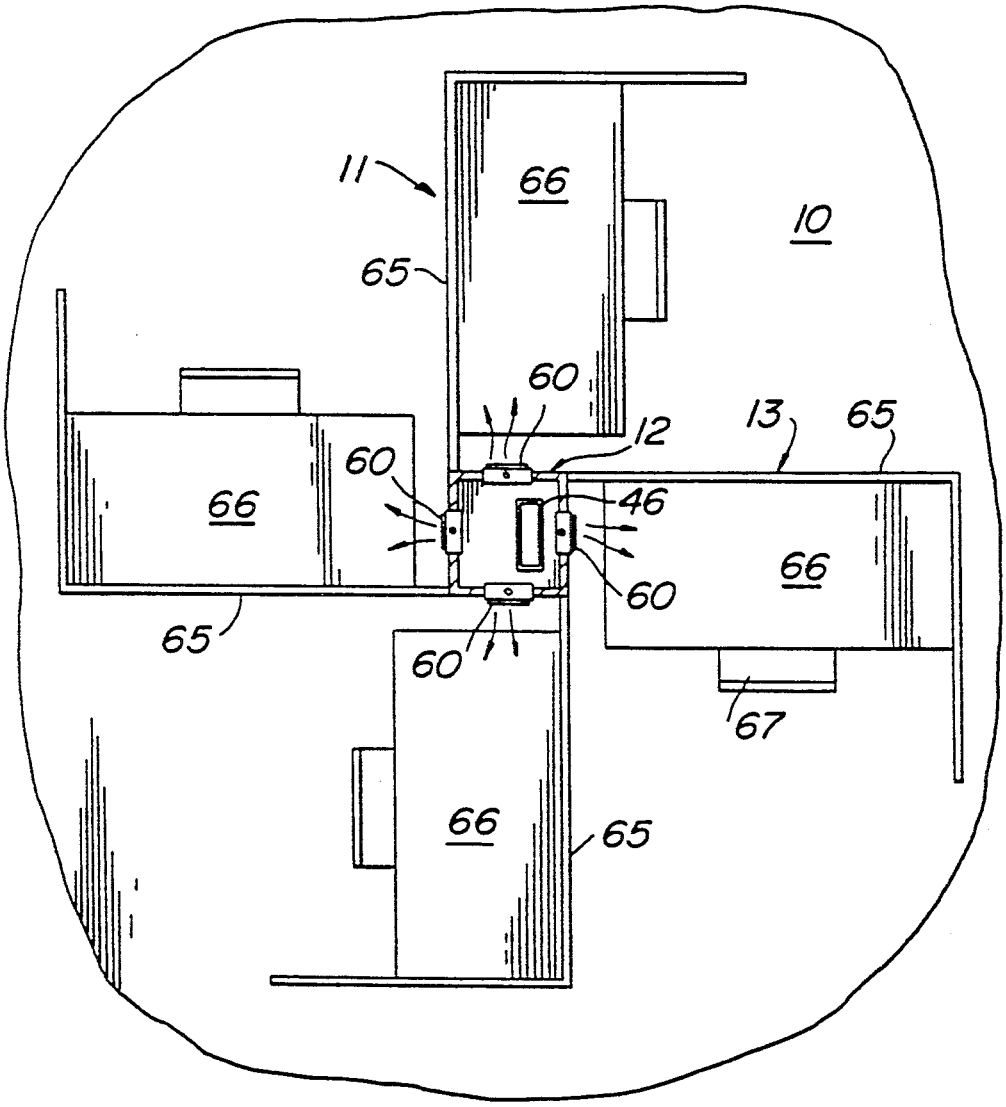
FIG. 2 is a horizontal sectional view of the personalized environmental control station of FIG. 1 taken along the line 2—2 of FIG. 1.

Referring now more particularly to the drawings, and specifically to FIG. 2 thereof, there is shown a building floor, generally designated 10, on which is installed a work station 11 including a central upright air column or passageway 12, and a plurality of individual work places, counters or desks 13 extending radially outwardly from the central column or passageway 12.

In the version shown in FIG. 1, the column or passageway 12 extends transversely of or upwardly from the floor 10. The floor 10 preferably includes support structure, such as structural beams or, in the illustrated embodiment, I-beams 15, which carry an upper generally horizontal surface or raised floor 16. A lower, generally horizontal surface or floor 17 is preferably located in spaced relation from the raised floor 16 and combines with the latter to define a generally horizontally extending interior hollow or plenum 18.

As is apparent from the description hereinafter, the plenum 18 is not obstructed by air ducts, or the like, and provides an efficient reservoir of conditioned air. It is understood by those skilled in the art that return air ducts and various utility conduits may extend through the plenum 18, such as electric power, electronic and optical communications, water, and the like. For example, electrical connector means or electrical conductors 19 can be installed in the plenum 18 for communication with connector means or an electrical outlet 50 in the column 12. A sprinkler system 20 may be provided which includes piping 21 positioned in the plenum 18 and one or more sprinkler heads 22 extending from the piping 21 through the lower floor 17. The plenum 18 is substantially unobstructed in all horizontal directions, notwithstanding the presence of structural beams 15, utilities 19, 20 and the like. In practice, the plenum 18 is generally coextensive in all horizontal directions with the floor 10 and room space above the floor.

In the present embodiment, it is preferred that a supply of conditioned air be in communication with the plenum 18, wherein the air flows as indicated by flow lines 25. The conditioned air in the plenum 18, illustrated by flow line 25, is preferably maintained at substantially atmospheric pressure to minimize air moving energy requirements and to substantially avoid leakage to and from the plenum 18 without the need for expensive sealing of the plenum 18. More specifically, the preconditioned air is pressurized above atmospheric pressure only to the extent needed to fill the plenum 18 with the conditioned air, but not further, since energy to move the air out of the plenum 18 is supplied by a separate fan when needed, as described in more detail hereinafter.

The upper layer or raised floor 16 of floor 10 is provided with one or more through openings as at 26. The openings 26 may be provided with closures for nonuse, as is understood by those skilled in the art.

Positioned over the floor opening 26 is the upstanding passageway or column 12, which is generally polygonal in cross section. More particularly, the column 12 comprises a plurality of generally upright complementary side walls 27 which combine to define therebetween an interior hollow 28.

In the present embodiment, it is preferred that the column 12 comprise four upstanding side walls 27, but the number may vary if desired, and the column or passageway 12 need not be of polygonal horizontal cross section, but may be configured as a cylinder of circular cross section, or other suitable configuration, as is understood by those skilled in the art.

Within the column or passageway 12 and adjacent to and spaced from the horizontal wall or floor 10, there is provided a generally horizontal partition or interior column wall 30 extending generally transversely across the interior hollow 28 of the column 12. Mounted on the horizontal partition 30 is an air mover or fan 31 preferably driven by suitable motive means 32, such as a motor. The fan 31 displaces air from the lower side of the horizontal partition 30 adjacent to floor 10 to the upper side of the horizontal partition 30. In addition, a generally vertical partition or wall 33 extends generally longitudinally within the interior hollow 28 and generally vertically between the horizontal partition 30 and the raised floor 16. The vertical partition 33 subdivides the space between horizontal partition 30 and raised floor 16 into a pair of compartments 34 and 35. Compartment 34 is in fluid communication through the floor opening 26, with the plenum 18, while compartment 35 is in fluid communication, through the air mover 31, with the interior hollow 28 above the horizontal partition 30.

Compartment 34 is subdivided by a generally horizontal partition 36 having a through opening 37; and similarly compartment 35 is subdivided by a generally horizontal partition 38 having a through opening 39.

Located in the vertical partition 33, for communication between the compartments 34 and 35, is an air proportioning device or valve 40 for passing conditioned air from compartment 34 to the fan 31 at a desired rate. Communicating between the interior of compartment 35 and the surrounding environment (i.e., the room space) is a one way air valve or relief damper 41. By the backdraft through relief damper 41, room air is passed in the direction of arrow 42 into compartment 35 for mixture with conditioned air passing in the direction of arrow 43 and through air proportioning valve 40. This mixture of air is passed by the fan or blower 31 through and upwardly beyond the horizontal partition 30. Valve 40 is controlled by a sensor 70 in chamber 34, which closes valve 40 as the temperature of the air 43 passing through the opening 37 drops. When valve 40 reaches its fully closed position, only the air indicated by the arrow 42 enters the air mover 31 through relief damper 41.

Spaced over the generally horizontal partition 30 is an additional generally horizontal partition 45 having a through opening or aperture 46 spaced laterally from the fan 31. An air heater or heat exchanger 44 is preferably interposed between the partitions 30 and 45, and between the fan 31 and aperture 46 for heating or conditioning air passing therebetween. That is, air passing in the direction of arrows 47 from fan 31 passes through heat exchanger 44 and hence in the direction of arrows 48 and 49 into the upper interior hollow 28 of the column or passageway 12. The air proportioning device 40 is controlled to mix room air 42 and conditioned air 43 in desired proportions, as is understood by those skilled in the art; fan 31 is suitably controlled, by a speed controlled motor 32, to move the air mixture at a desired rate; and heat exchanger 44 is suitably controlled to impart a desired heating or conditioning influence on the air being moved.

In the embodiment shown in FIG. 1, the upper end of column or passageway 12 remote from the floor 10 is provided with an end wall 55, preferably having a through opening 56. Adjacent to and spaced below the upper column end wall 55, within the column 12 is a generally horizontal internal wall or partition 57 having mounted therein a relief damper 58. That is, the horizontal partition or wall 57 is spaced or elevated from the horizontal wall or partition 45, for passage of conditioned air 49 from the hollow 28 of column 12 through relief damper 58, upon a sufficient pressure difference developing on opposite sides of the relief damper 58 when the outlets 60 are positioned near their fully closed position.

A plurality of air outlets or registers 60 are provided in the walls 27 of column or passageway 12, preferably spaced between the partitions 45 and 57. The air outlets or registers 60 are advantageously adjustable both volumetrically and directionally. In practice, each wall 27 of the column 12 is preferably provided with an adjustable register 60. When air is fed into the hollow 28 between partition 45 and 57, as indicated by flow lines 61, it exits through the registers 60, any excess air passing upwardly and outwardly through the relief damper 58 and opening 56, as indicated by flow lines 62.

At the upper end or top wall 55 of column 12 there is preferably mounted a lighting means or luminaire 63, such as an annular lamp seated on arms 64 extending outwardly from the column 12, for dispensing light upwardly and downwardly to the surrounding workplaces. Cool air moving over the lamps reduces their operating temperature. This helps the lamps work more efficiently and lengthens their useful life.

As shown in FIG. 2, each work place preferably includes a generally upright separator or wall 65 extending generally radially outwardly from the column or passageway 12. More specifically, it is preferred that each wall 65 extend generally radially outwardly from the passageway or column 12 at a location thereon spaced between an adjacent pair of air outlets or registers 60. A work bench or desk 66 may be located at a suitable working height close to each wall 65, and may be provided with a respective seat or stool 67. Thus, as best seen in FIG. 2, the space between each adjacent pair of generally outwardly extending walls 65 defines an individual work space, and each air outlet or register 60 is associated with a respective work space for dispensing conditioned air at the desired rate and in the desired velocity and direction, as selectively and personally controlled by the occupant of the work space.

Referring now to FIG. 1, a thermostatic sensor is shown at 70, which is located in the supply air stream 43, and thermostatically controls the operation of the valve 40, fan 31 and heater or heat exchanger 44. As is understood by those skilled in the art, these components are individually controlled; or the control of these components may be automatic and located remotely from the work station, for example at a central microprocessor. However, the individuals within each work space are able to provide their own desired quantity, velocity and direction of conditioned air through their respective air outlets or registers 60. The overall room temperature, however, say in hot weather conditions, need not be so cool as the air temperature produced at the work places, to effect substantial savings in cooling demand. Further, the supply air energy demand is minimal as primary air movement is only sufficient to fill the plenum 18; and air from the plenum is moved only as and when needed by the individual fan 31.

Figure 3:
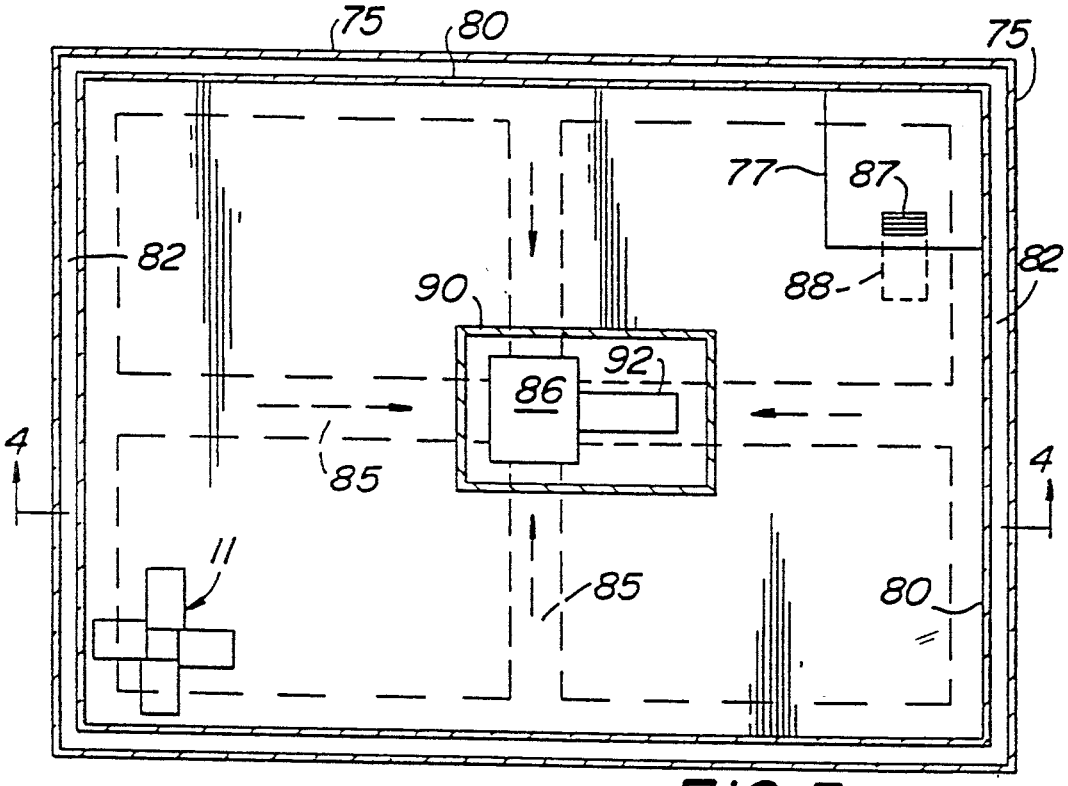
FIG. 3 is a plan view, in partial cross section, showing a typical building floor employing the personalized air conditioning system of FIG. 1.
Figure 4:
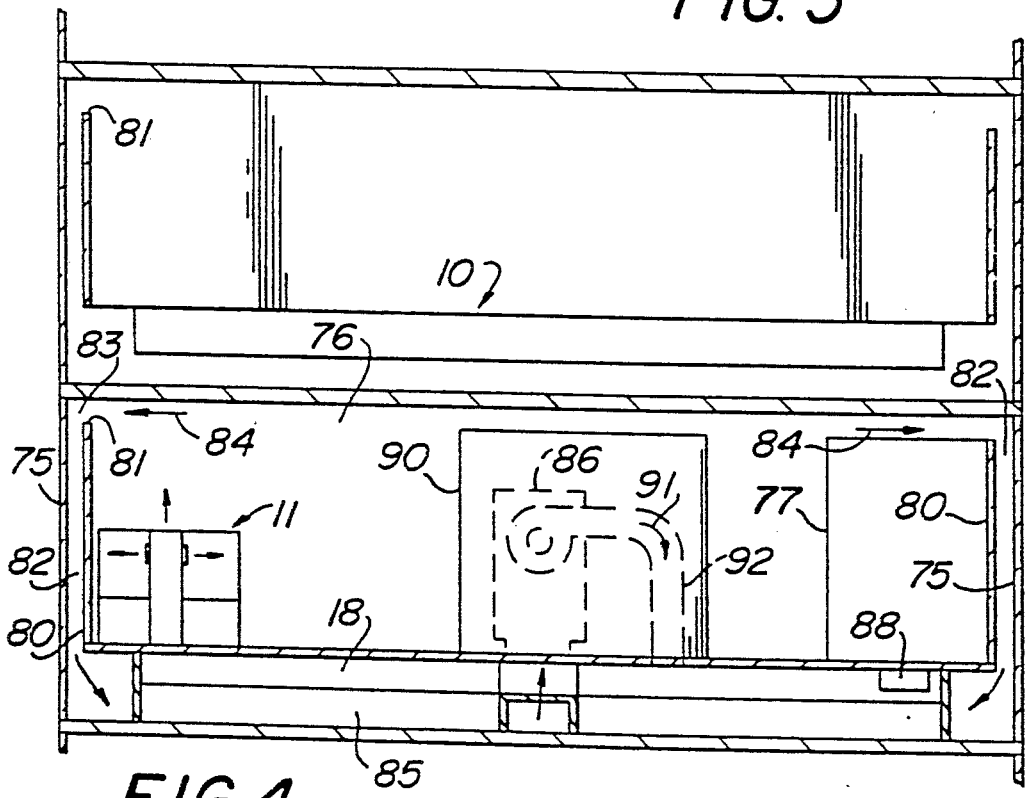
FIG. 4 is a sectional elevational view taken generally along the line 4—4 of FIG. 3.

Referring now to FIGS. 3 and 4, the plan view of FIG. 3 illustrates a generally horizontal partition or floor 10 and circumferential generally upright outer walls 75 bounding the conditioned space 76. A single work station 11 is shown in one corner of the space 76, but, as is understood by those skilled in the art, any desired number of work stations may be selected and located as desired. A private office 77 is shown in the diametrically opposed corner of the space 76, but may be located elsewhere at the designer's choice, without departing from the spirit and scope of the invention.

Extending generally parallel along and spaced inwardly from the outer walls 75 are inner walls 80, which upstand from the generally horizontal floor 10 to an upper bounding edge 81, adjacent to and spaced below the next adjacent upper floor 10, as shown in FIG. 4. Thus, the inner walls 80 combine with the outer walls 75 to define an interwall space, generally designated 82, substantially surrounding the room space 76, and interposed between the room space and the exterior surface of the outer wall 75. The spacing of the upper edge 81 of inner wall 80 below the next upper horizontal partition 10, as at 83, defines an upper fluid communication means or conduit for passing return air or removing room air, as in the direction of flow lines 84, to the interwall space 82.

In the present embodiment, it is preferred that the lower region of the interwall space 82 be open to one or more return air ducts 85. The ducts 85 pass through the plenum 18, but are not in fluid communication with the plenum 18. The plenum 18 is preferably in fluid communication with an air conditioning unit 86, for passing conditioned air. The return air ducts 85 in the plenum 18 thus define a lower fluid communication means for removing air from the interwall space 82 for conditioned air to be subsequently returned to the plenum 18. Thus, return air passes downward through the interwall space 82 to define an insulating air curtain interposed between the room space 76 and the exterior surface of the building. Due to the air curtain, heat gains or losses between the room space and building exterior are minimized for reduced heating or cooling load and for providing better energy efficiency. Further, the interwall space 82 may be utilized for blinds, or other accessories, and preferably the inner walls 80 are transparent for light permeability and are preferably movable, as on tracks, for easy access to the interwall space. The lower fluid communication means or return air ducts 85 may be provided with suitable dampers or other flow control means communicating with the air supply plenum 18 for adjusting the return air temperature, if desired, and to lighten the load on the central unit 86.

In the embodiment shown in FIG. 3, there is provided a central core 90 in the room space 76, including the conditioning unit 86 for passing conditioned air 91 through conduit 92 to the plenum 18. The central core 90 may house other utilities, such as a telephone communication housing (not shown). However, as is understood by those skilled in the art, the air conditioned unit 86 need not be located in the space 76, but may be located elsewhere, such as on the roof of the building.

The office 77 preferably includes walls which extend from the floor to the ceiling, for added privacy. In the embodiment shown in FIG. 3, a floor supply outlet 87 is located in the office 77 and communicates with the plenum 18, as by a fan-air terminal 88 in a similar way to that shown in column or passageway 12 of FIG. 1.

Figure 5:
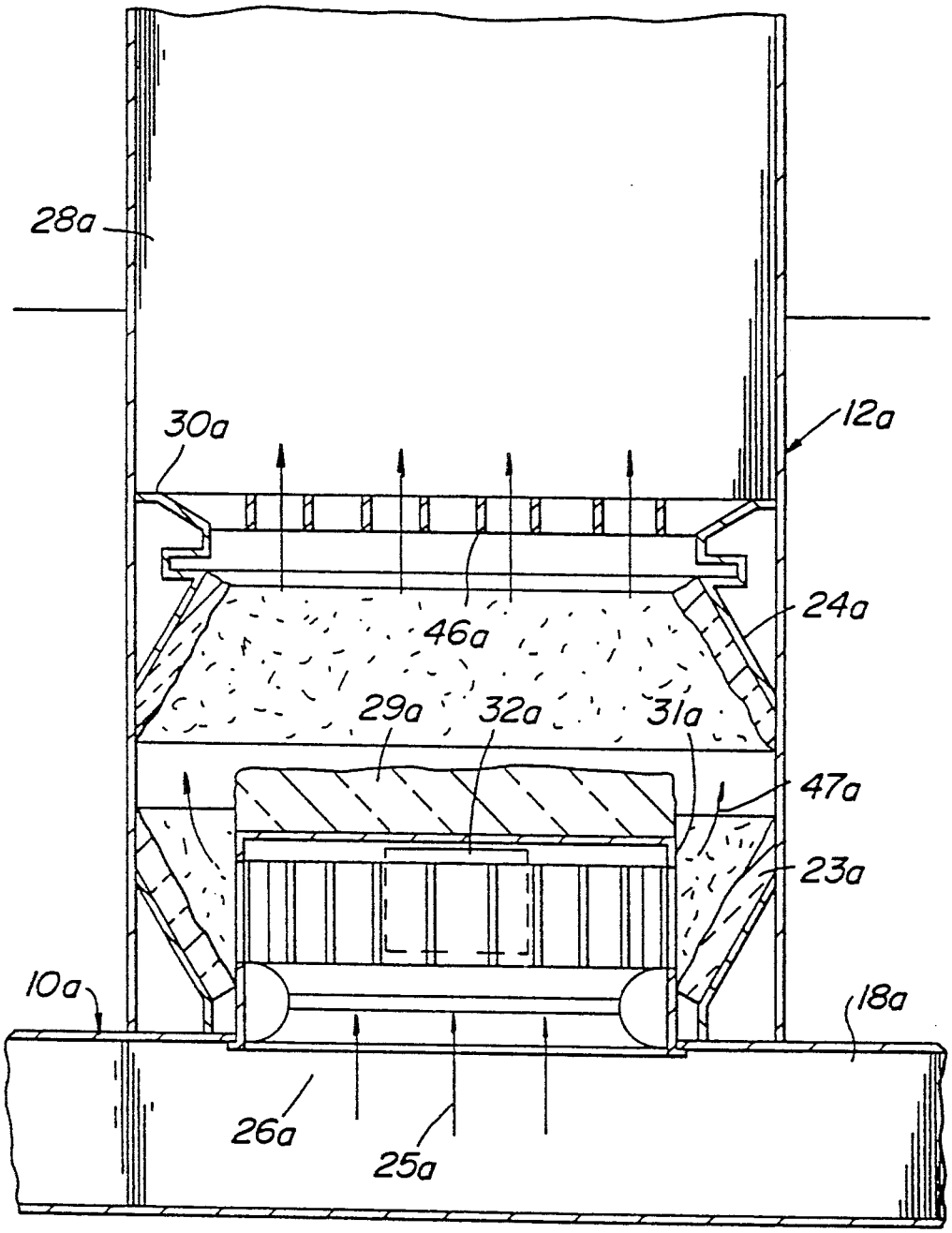
FIG. 5 is a sectional elevational view showing a modified embodiment of the lower region of the station of FIG. 1.

A slightly modified embodiment is shown in FIG. 5, wherein a passageway or column **12*a* located on a floor 10*a* has its hollow interior 28*a* communicating downwardly through a floor opening 26*a* with a floor plenum 18*a***.

In this embodiment, an air mover, fan or blower **31*a* is mounted over the floor opening 26*a*, and is driven by suitable motive means, preferably a motor 32*a*. It is understood by those skilled in the art, that the air mover or blower 31*a* may be of the centrifugal or mixed flow type, having an inlet 25*a* for receiving plenum air; similarly the air may emerge peripherally 47*a* or axially, or both, from the air mover or fan 31*a***.

Surrounding the air mover or blower **31*a* are upwardly extending walls 23*a* for directing the air 47*a* exiting from the fan 32*a* generally upwardly; and, upwardly extending walls 24*a* are provided within the column 12*a* for directing air to the horizontal wall opening 46*a*. The walls 23*a* and 24*a* are preferably fabricated of sound insulating material, and a layer of sound insulating material 29*a* is also provided on top of the air mover 31*a***, for minimizing noise.

Figure 6:
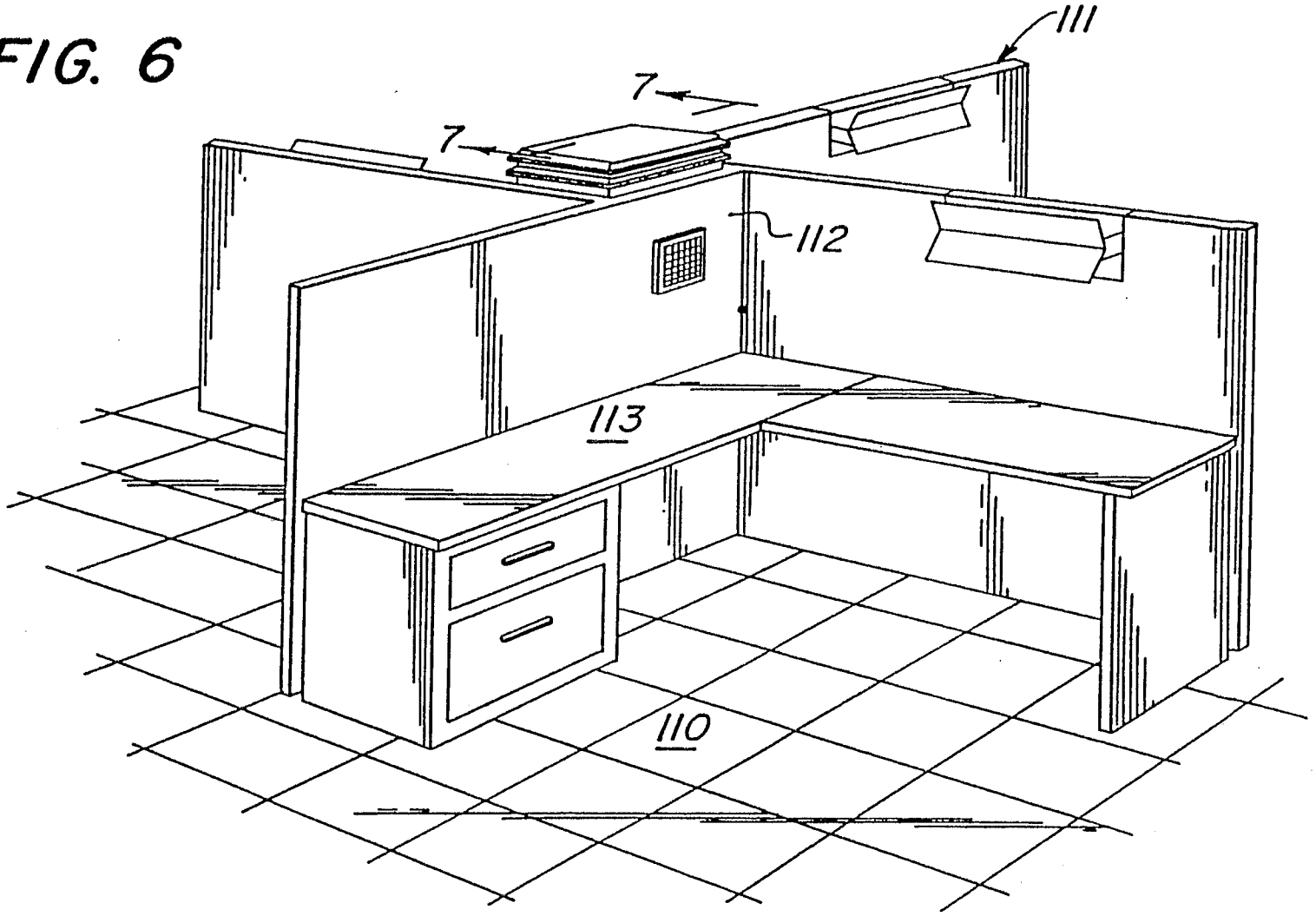
FIG. 6 is a top perspective view showing a slightly modified embodiment of the personalized environmental control work station in accordance with of the present invention.

Referring now to FIG. 6, there is shown a building floor 110, on which is installed a work station 111 including a central upright air column or passageway 112, and a plurality of individual work spaces, counters or desks 113 extending outwardly from the central column or passageway 112.

Figure 7:
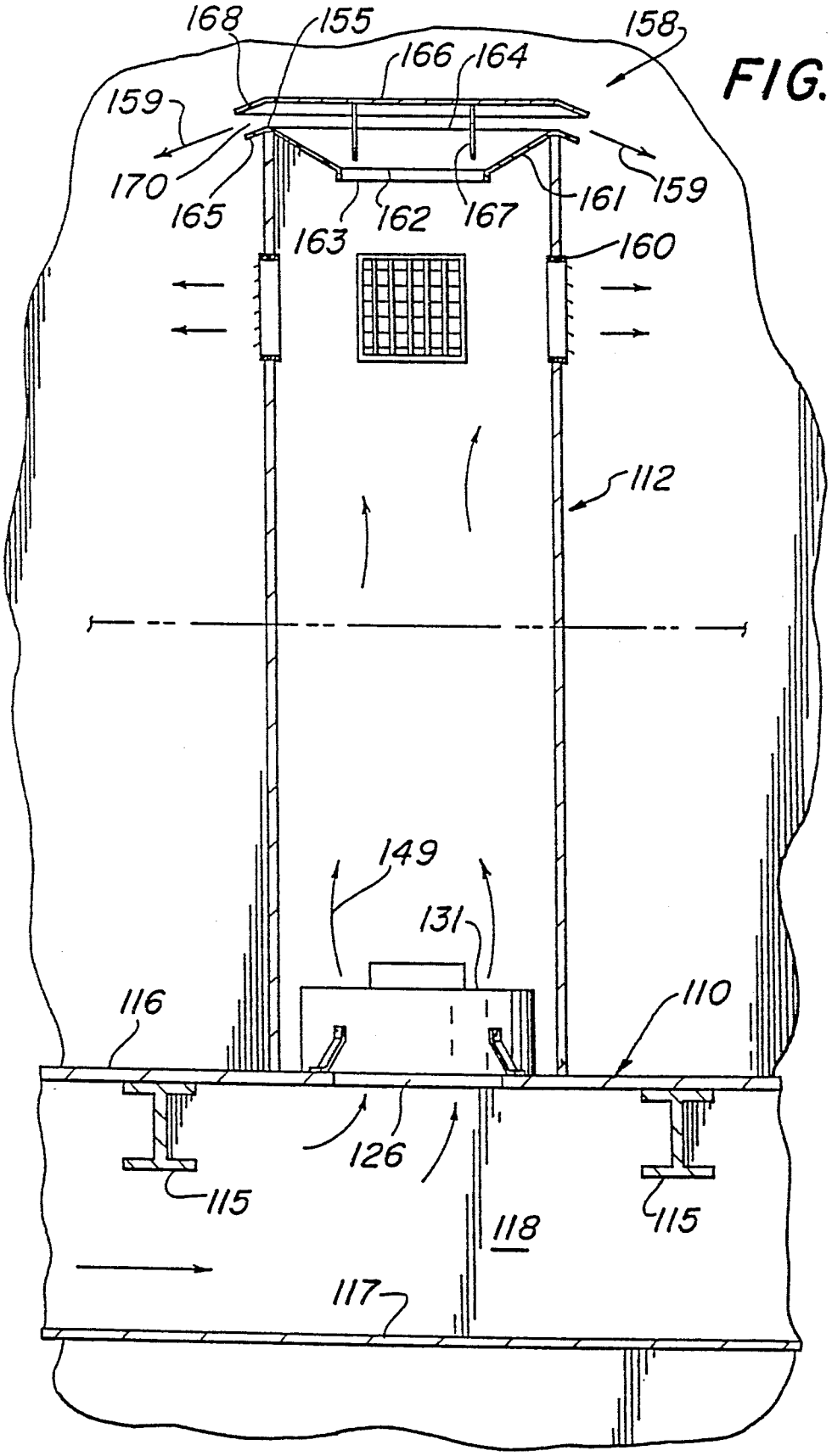
FIG. 7 is a greatly enlarged partial cross-sectional elevational view taken generally along the lines 7—7 of FIG. 6.

The column or passageway 112 is shown in cross section in FIG. 7 and extends transversely of or upwardly from the floor 116. The floor 116 includes support structure, such as structural support members 115 which carry a generally upper horizontal surface or raised floor 116. A generally lower horizontal surface or floor 117 is spaced below the raised floor 116 and combines with the latter to define a generally horizontally extending interior hollow or plenum 118. Preferably, the support members 115 are spaced over the lower floor 117 so that the plenum 118 is generally unobstructed horizontally and substantially coextensive horizontally with the raised floor 116 and the room space above the floor. Further, the plenum 118 is preferably capable of containing utility conduits, as mentioned previously, also without obstructing the horizontal movement of air in the plenum.

A central supply of conditioned air communicates with the plenum 118, as described above. The conditioned air is supplied slightly above atmospheric pressure, such that air flows into the plenum 118 without causing appreciable leakage from the plenum 118. Thus, the plenum 118 need not be tightly sealed as in conventional duct systems which also may incorporate plenums. This minimum need for pressure in the plenum 118 minimizes the energy requirements for moving conditioned air into the plenum 118 and minimizes the leakage of conditioned air from the plenum 118 while precluding the leakage of atmospheric air into the plenum. As previously described, conditioned air removal from the plenum 118 to the room space is effected only when and where needed by a separate air mover or fan 131 in each column 112.

The column 112 extends upwardly from the upper floor surface 116 over a selectively located floor opening 126. An air mover or fan 131 is located in the column 112 in a lower region thereof for drawing conditioned air from the plenum 118 upwardly into the column 112, as indicated by flow lines 149. The fan or air mover 131 is preferably thermostatically controlled as described hereinbefore.

The column or passageway 112 is provided in an upper region thereof, spaced below the upper column end 155, with a plurality of circumferentially spaced air outlets, openings or registers 160. The registers 160 are preferably selectively controllable for volume, velocity and direction of air passing outwardly therefrom to the respective desk regions. As in the embodiment illustrated in FIG. 1, the column 112 may be four sided or rectangular, as for use with four desk areas, and may employ four registers 160. However, as is understood by those skilled in the art, the column 112 may be of other configurations, such as circular in cross section, and may include additional registers 160.

Extending across the upper end of the column 112 is an air distributor 158 which smoothly and in a manner approaching laminar air flow circumferentially distributes conditioned air, in the direction shown by flow lines 159, to the surrounding room space at a location spaced below the room ceiling. Thus, the conditioned air dissipates into the room space at an elevation which is occupied rather than being wasted at an upper, unoccupied elevation of the room space.

The distributor 158 is an air outlet, in addition to the air outlets 160, but is general to the entire work station 111, rather than local to a specific desk region. The distributor 158 may be comprised of a generally frustoconical conduit 161 having its smaller end downwardly, within the column 112 and including an opening 162 bounded by a generally cylindrical flange 163. The lower, inlet end 162 of the distributor conduit 161 is centrally disposed within the column 112, spaced below the upper column end 155, and spaced above the level of the air outlets or registers 160. The distributor conduit 161 may enlarge or flare upwardly to an upper outlet end 164, which opens upwardly and rests on the upper end 155 of the column 112. A circumferential lip 165 extends entirely about and radially outwardly from the upper end 164 of the distributor conduit 161, and projects laterally outwardly beyond the column 112, and declines obliquely with respect to the column 112.

An upper plate or deflector 166 extends generally horizontally in spaced relation over the upper end 164 of the distributor conduit 161, and is suitably supported on the latter by upright studs or fasteners 167. The generally horizontal deflector 166 is substantially congruent to and coextensive with the upper open end 164 of the upwardly flaring distributor conduit 161, and is provided with a circumferentially extending lip or flange 168 which overlies the lip or flange 165 and also declines obliquely outwardly as the latter.

Thus, the distributor 158 defines a passageway for air entering upwardly through lower opening 162, to turn horizontally and exit circumferentially between the lower and upper lips 165 and 168, as in the direction of flow lines 159. The circumferential space 170 between the lips 165 and 168 provides an air outlet local to the work station 111 and common to the several desk clusters 113, for uniformly distributing air with a minimum of drafts or disturbance. That is, in contrast to the prior art wherein it is desired to pass conditioned air turbulently into room space to achieve immediate mixture with the air throughout the room, by the use of the present invention it is advantageous for many reasons to introduce air in a smooth, substantially laminar condition with a minimum of turbulence. This effects considerable savings in air handling energy and comfort to occupants in the immediate area of the air outlet by premixing the conditioned air with return air from the room, as in the column 12 of FIG. 1. While premixing of conditioned and returned room air is not shown in FIG. 7, this may be achieved in the same manner as in FIG. 1, or may be performed in the plenum 118. The present invention prevents mixing of the entire room air mass and hence prevents cross-contamination of individual room areas by smoke, dust, bacteria, and other airborne impurities.

As the cross section of air movement through the distributor 158 decreases in height along the frustoconical conduit 161, the cross section increases in circumference, so that air velocity may remain relatively constant to achieve the smooth laminar type flow.

Figure 8:
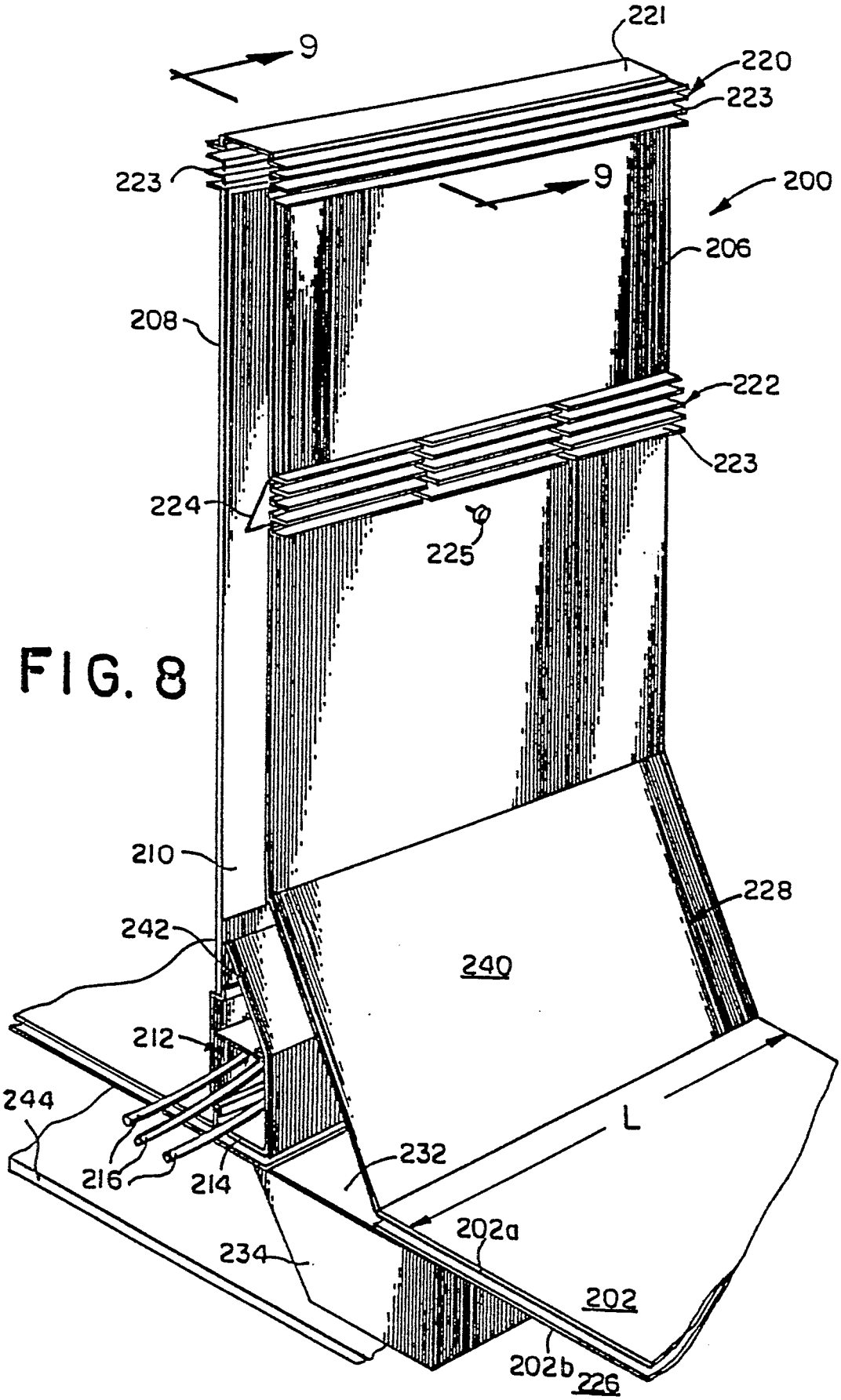
FIG. 8 is a perspective view, partially broken away, of a room divider for supplying conditioned air to an area in accordance with the present invention.
Figure 9:
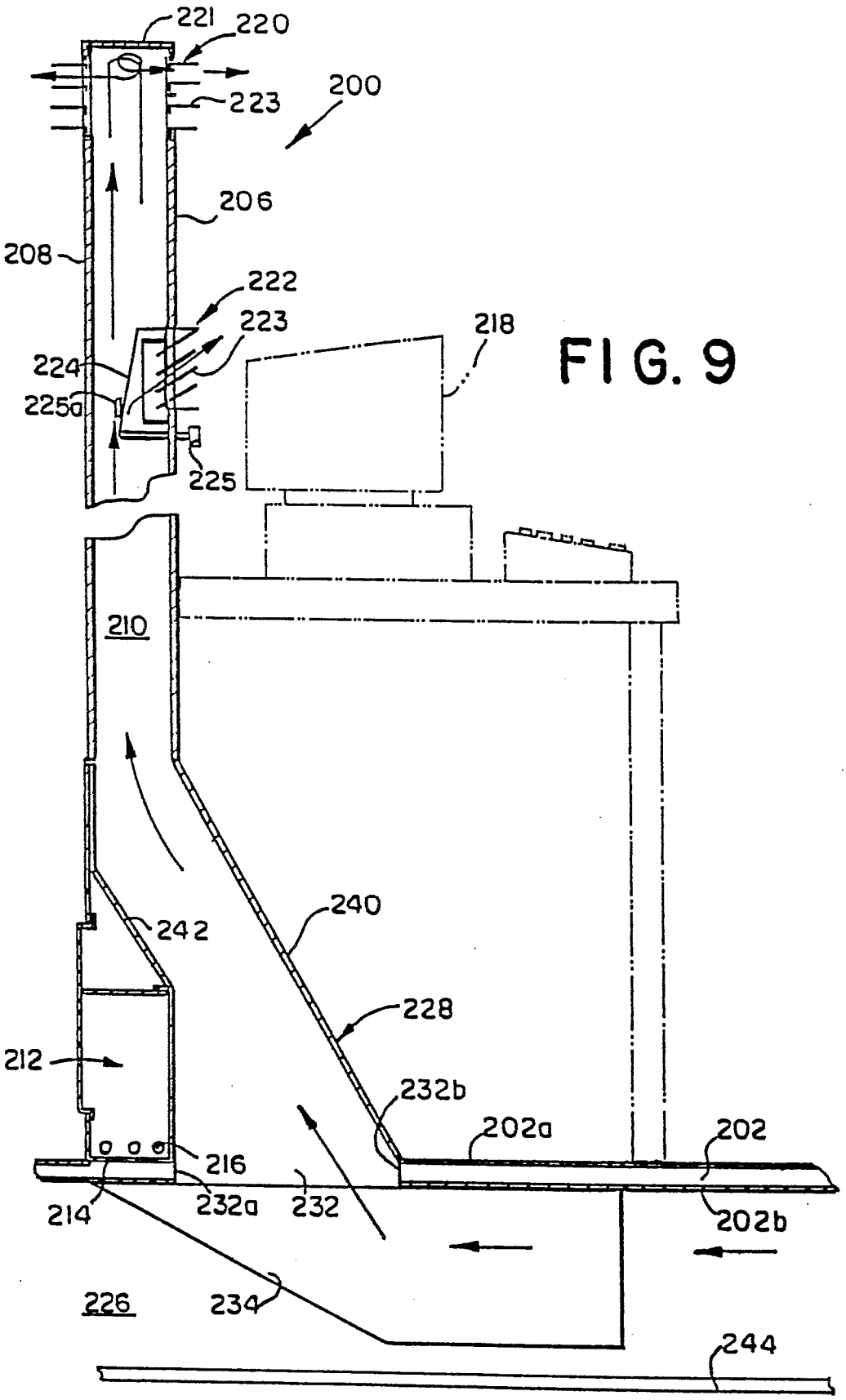
FIG. 9 is a cross-sectional view of the room divider of FIG. 8 taken along lines 9—9 of FIG. 8 additionally showing in phantom typical equipment proximate thereto.

Referring now to FIGS. 8 and 9, wherein like numerals indicate like elements throughout, there is shown in FIG. 8 a perspective view of a room divider 200 extending upwardly from a floor 202 having first **202*a* and second 202*b* sides or surfaces. The room divider 200 is employed for supplying conditioned air to an area surrounding the room divider 200** in accordance with an alternate embodiment of the present invention.

A first generally flat panel 206 is integrally connected to a second generally flat panel 208 to form the room divider 200. As shown in FIG. 9, the first panel 206 is generally parallel to and spaced apart from the second panel 208 by at least a predetermined distance to define a generally enclosed air flow area 210 for allowing air to flow between the panels 206, 208.

In the present embodiment, it is preferred that the room divider 200 generally be a standard partition wall used in forming conventional cubical or work stations, as is understood by those skilled in the art. That is, typically the room divider 200 comprises a metallic or polymeric frame (not shown) having interchangeable panels releasably secured thereto. The panels are usually available in different colors or fabric surfaces for matching the room divider to different interior designs.

It is understood that the panels 206 and 208 can be releasably secured to the room divider frame (not shown) in a manner within the abilities of those skilled in the art. Consequently, the present invention is not limited to the methods or instrumentalities used to secure the panels to the frame.

In the present embodiment, it is preferred that the predetermined distance between the first panel 206 and the second panel 208 be selected such that air efficiently flows through the room divider 200 with sufficient force or pressure to disperse to the surrounding area (in a manner hereinafter described) without creating excessive noise, as is understood by those skilled in the art.

As shown in FIG. 9, the room divider 200 may include a bottom portion 212 preferably positioned proximate the second panel 208. The bottom portion 212 is preferably also positioned adjacent the first side **202*a* of the floor 202 and extends the entire length L (FIG. 8) of the room divider 200. Preferably, the lower end of the first panel 206 is positioned a distance from the bottom portion 212 for allowing conditioned air to flow therebetween and into said air flow area 210** in a manner which will hereinafter become apparent.

In the present embodiment, the bottom portion 212 preferably includes a generally imperforate bottom member 214, such that air cannot flow directly through the bottom portion 212 from or to the air flow area 210.

As shown in FIG. 9, in the present embodiment, it is preferred that the bottom portion 212 be generally rectangular in cross section for receiving communication and electrical cables 216 related to equipment 218 positioned proximate the room divider 200. More particularly, the bottom portion 212 preferably is a utility duct, constructed of sheet metal, which is typically installed in standard room dividers and is usually integral with the frame, as is understood by those skilled in the art. However, it is also appreciated by the ordinarily skilled artisan that the bottom portion 212 can be configured in other shapes (e.g., trough shaped) or constructed of other materials, such as a polymeric material.

Referring now to FIG. 9, there is provided air outlet means, integral with at least one of the first panel 206 and the second panel 208 and elevated at a predetermined distance from the floor 202 for allowing air within the air flow area 210 to flow therethrough to an area surrounding the room divider 200 and/or directly to or near a person situated proximate thereto.

In the present embodiment, it is preferred that the air outlet means comprise a first register 220 positioned at a top portion 221 of the first and second panels 206, 208 or proximate the top of the room divider 200 for dispersing conditioned air from the air flow area 210 to provide conditioning of the area generally surrounding the room divider 200. It is also preferred that the air outlet means further comprise a second register 222 positioned in the first panel 206 between the top portion 221 and the bottom portion for directly supplying or directing a flow of conditioned air on or near a person or worker (not shown) positioned proximate the room divider 200. In this manner, the person can take advantage of the direct flow of the conditioned air through the second register 222 for enhanced personal comfort, etc. However, due to the two register arrangement, the personal comfort of the person does not result in a significant change in the conditioning of the remainder of the area surrounding the room divider 200 due to the flow of conditioned air through the first register 220, as well as the conditioning of the surrounding area by the flow of conditioned air through the second register 222.

In the present embodiment, it is preferred that the second register 222 be positioned at a height generally corresponding to the height of the average person's head when seated within the work station (i.e., for operation of the equipment 218) for directly supplying a flow of conditioned air to a worker seated proximate the room divider. However, it is understood by those skilled in the art that the second register 222 can be positioned anywhere between the top portion 221 and bottom portion of panel 206. For instance, the second register 222 could be positioned proximate the floor or directly aligned with the equipment 218 for supplying conditioned air thereto.

As shown in FIG. 8, in the present embodiment, it is preferred that the registers 220 and 222 extend generally the entire length L of the room divider 200 for allowing greater volumes of air to flow therethrough without creating excessive background noise. However, it is understood by those skilled in the art that the registers 220, 222 could be down sized to a smaller length without departing from the spirit and scope of the invention.

In the present embodiment, it is preferred that the registers 220 and 222 include at least several individual louvers 223 and damping means (not shown) for providing both volumetric and directional control of the air flowing therethrough, in a manner similar to that used for ventilating passenger vehicles. More particularly, it is preferred that the registers 220 and 222 be adjustable to direct air flow both vertically and horizontally. Additionally, it is preferred that the registers 220 and 222 each be volumetrically controlled between a fully open and closed condition. However, it is understood by those skilled in the art, that other types of registers may be used without departing from the spirit and scope of the invention. For instance, register 220 could be a standard, non-adjustable outlet or an outlet having only directional control. The air outlet means are preferably integral with the panels 206 and 208 to facilitate retrofitting existing room dividers by merely replacing a standard panel with a panel having registers therein.

It is appreciated by those skilled in the art that the present invention is not limited to any specific size, type or number of registers. Specifically, it is preferred that the number and type of registers be selected to conform to the type of room in which the room divider 200 is positioned. For instance, if the room divider 200 is positioned against a permanent wall (not shown) it would only be necessary to place an outlet means or register in one of the panels 206 or 208. Correspondingly, in circumstances in which there are occupants on both sides of the room divider 200, registers can be provided in both panels 206 and 208.

Referring now to FIG. 9, a baffle means is positioned between the first and second registers 220, 222 and between the first and second panels 206, 208 for controlling the respective flow of conditioned air through the first and second registers 220, 222. In the present embodiment, it is preferred that the baffle means comprise a pivotable or movable damper 224 positioned proximate the second register 222 and extending along the entire length L of the room divider 200 for controlling the flow of air through each respective register, as is understood by those skilled in the art. However, it is also understood by those skilled in the art, that other means can be used for controlling the flow of air through the registers 220 and 222, such as a static damper (not shown).

In the present embodiment, the damper 224 includes control means comprising an adjustment handle 225 for allowing the position of the damper 224 to be selectively or individually adjusted by persons proximate the room divider 200 for personally controlling the flow of air through register 222. It will be appreciated by those skilled in the art that the position of the damper 224 and/or the positions of the registers 220, 222 does not affect the overall conditioning of the area surrounding the room divider 200 because the overall flow of conditioned air to the surrounding area remains generally constant. Thus, for example, if a person seated near the room divider 200 was to adjust the damper 224 so that no conditioned air was to flow through register 222 upon or near the person, all of the conditioned air flowing through the air flow area 210 would pass through the first register 220 to condition the air in the area surrounding the room divider 200. Similarly, if the damper 224 was adjusted so that some conditioned air flows through the second register 222 for impingement on the person, the remainder of the conditioned air flowing through the air flow area 210 would pass through the first register 220 resulting in substantially the same volume of conditioned air flowing through the registers 220, 222 and the same overall conditioning in the area surrounding the room divider 200. As shown in FIG. 9, a stop member **225*a* within the flow area 210 prevents the damper 224 from completely blocking air flow through the first register 220**.

In the present alternate embodiment, it is preferred that the damper 224 be directly connected (not shown) to one of the panels 206 or 208 for support and access. However, it is understood by those skilled in the art that the pivotable damper 224 could be supported by the room divider frame or other means without departing from the spirit and scope of the invention.

As shown in FIGS. 8 and 9, the room divider 200 includes flow direction control means for directing conditioned air from a second side **202*b* of the floor 202 into the air flow area 210 whereby air flows from the second side 202*b* of the floor 202 into the air flow area 210 and through the air outlets 220 and 222 to the surrounding area. In the present embodiment, it is preferred that a plenum or plenum chamber 226 be positioned between the second side 202*b* of the floor 202 and the lower floor 244**, similar to that described above.

As shown in FIG. 9, in the present embodiment, the flow direction control means comprises an intake boot 228 extending from the air flow area 210 to a through aperture 232 in the floor 202 and an air moving means for moving conditioned air from the plenum 226 into and through the intake boot 228 to the air flow area 210. Preferably, the air moving means is positioned on the second side **202*b* of the floor 202 or it may be installed above the floor 202 such as within the flow area 210**.

In the present embodiment, it is preferred that the aperture 232 extend the length L of the room divider 200 and include a first side 232*a* positioned adjacent the room divider bottom member 214. The aperture preferably includes a second side 232*b* spaced a predetermined distance from the bottom member 214. Preferably, the aperture 232 is generally rectangular in shape. However, it is understood by those skilled in the art that the aperture 232 can be configured in other shapes or sizes, such as square or trapezoid and may also span only a portion of the length L of the room divider 200.

In the present embodiment, it is preferred that the intake boot 228 comprise a first generally planar complementary partition 240 constructed of metallic material extending between the first panel 206 and the second side 232*b* of the aperture 232 for guiding conditioned air into the air flow area 210. However, it is understood by those skilled in the art that the partition 240 could be constructed of other materials, such as a polymeric material or wood for enhancing the cosmetic characteristics of the room divider 200. Preferably, a second, smaller complementary partition 242 is provided between the upper corner of the bottom portion 212 and the second panel 208 for guiding air flow into the air flow area 210, as is understood by those skilled in the art. Preferably, the second partition 214 is generally parallel to partition 240 as shown. It should be understood that in other embodiments partition 242 may not be present.

Preferably, the first partition 240 and the second partition 242 are sufficiently spaced apart to allow conditioned air from the plenum 226 to flow into the air flow area 210 at a sufficient rate to allow the conditioned air to flow through the registers 220, 222 to the surrounding area without creating excessive noise.

In the present embodiment, it is preferred that the air moving means be comprised of a blower or fan unit 234 for moving air within the plenum 226 through the intake boot 228 into the air flow area 210 and through the registers 220 and 222 to the surrounding area. The unit 234 may be manually controlled by a control unit (not shown) positioned proximate the room divider 200. However, it is understood by those skilled in the art, that the unit 234 can be automatically controlled by a thermostat (not shown) or other temperature or air flow regulating means, without departing from the spirit and scope of the invention.

In the present embodiment, the blower or fan unit 234 has an output opening (not shown) which generally corresponds to the size and shape of aperture 232. This is necessary to overcome the resistance of the intake boot 228 and panels 206, 208 to assure sufficient air flow through the air flow area 210 into the surrounding area. This requirement further necessitates the use of an intake boot 228 which serves as a flow directing means. Hence, even if the utility duct 212 was removed, it would still be desirable to provide an intake boot 228.

Preferably, the room divider 200 uses a single blower or fan unit 234. However, it is understood by those skilled in the art that a plurality of spaced units could be used to obtain the requisite air flow. Similarly, the present invention is not limited to any particular length of the intake boot 228. That is, the length of the intake boot 228 may be less than the entire length L of the room divider 200, without departing from the spirit and scope of the invention.

Figure 11:
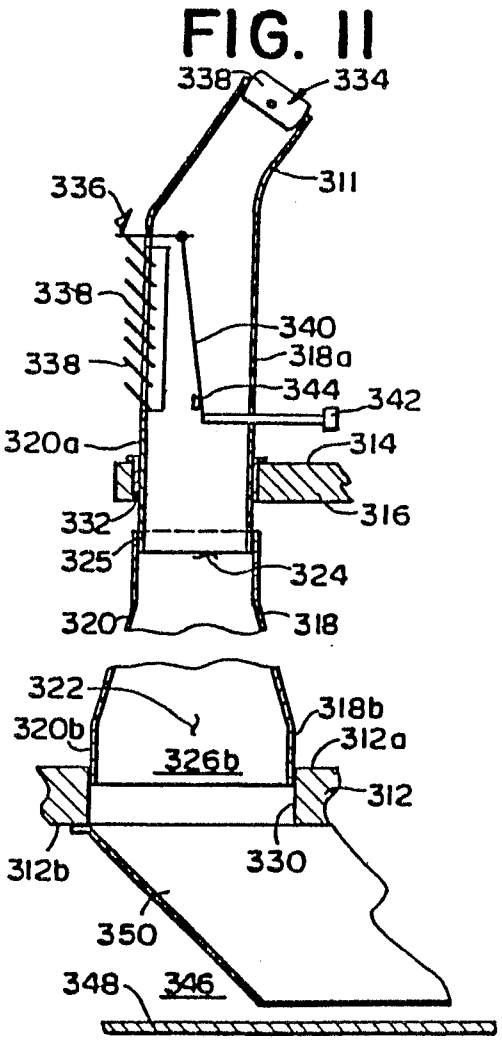
FIG. 11 is a cross-sectional view of the personal air terminal of FIG. 10 taken along lines 11—11 of FIG. 10.
Figure 10:
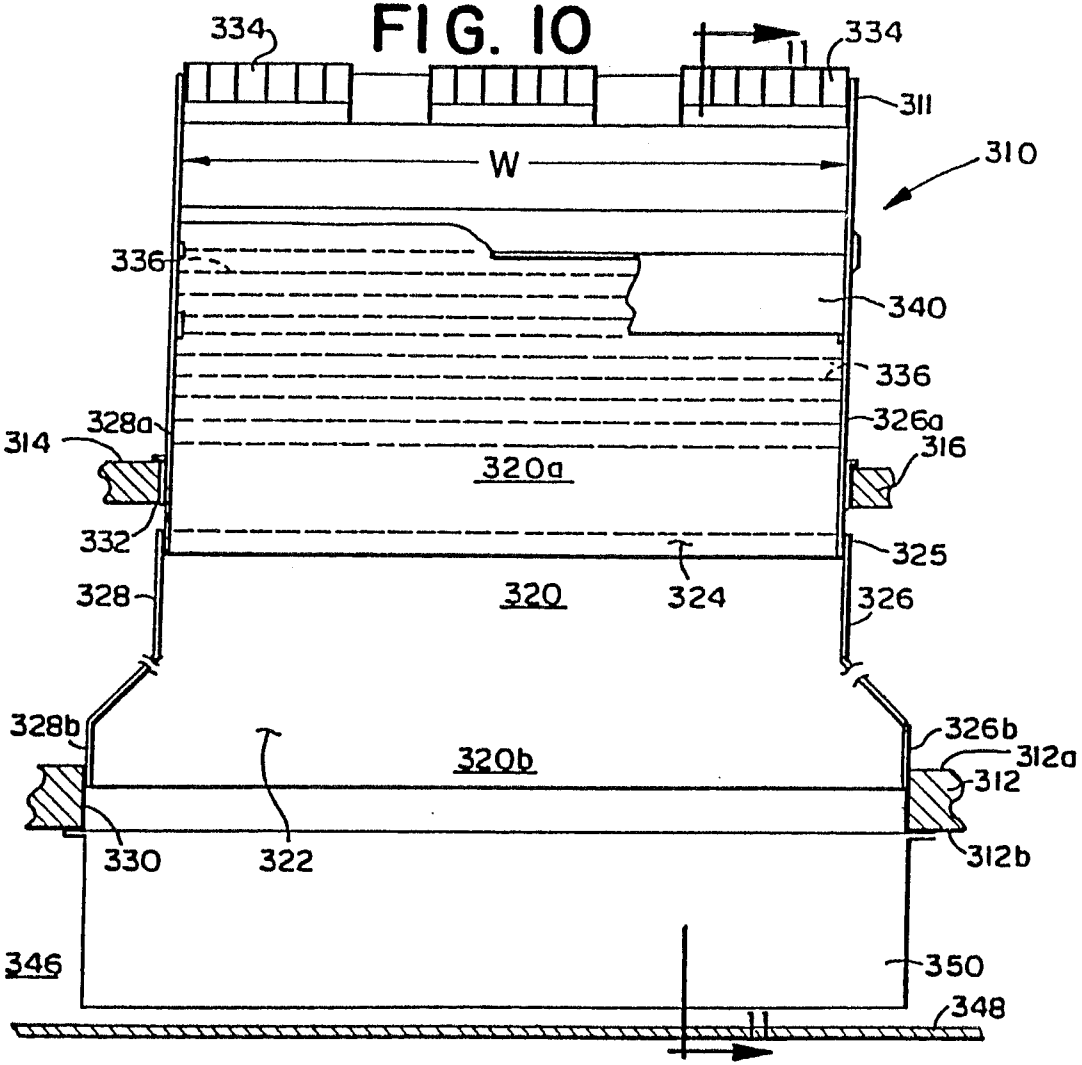
FIG. 10 is a cross-sectional view, partially broken away, of a personal air terminal for supplying conditioned air to an area in accordance with the present invention.

Referring now to FIGS. 10 and 11, wherein like numerals indicate like elements throughout, there is shown in FIG. 10 a personal air terminal, generally designated 310, extending from a floor or mounting member 312 having first 312*a* and second 312*b* sides or surfaces, through a surface 314 of a desk 316. The personal air terminal 310 is employed for supplying conditioned air to an area surrounding the personal air terminal 310 in accordance with an alternate embodiment of the present invention.

While in the present embodiment, it is preferred that the personal air terminal 310 extend upwardly from the floor 312, it is understood by those skilled in the art, that the personal air terminal 310 can extend downwardly from a ceiling or outwardly from a wall without departing from the spirit and scope of the invention.

Referring now to FIG. 11, a first wall 318 is integrally connected to a second wall 320 to form the personal air terminal 310. The first and second walls 318, 320 each have upper and lower portions 318*a*, 318*b*, 320*a* and 320*b*, respectively. The lower portion 318*b* of the first wall 318 is preferably spaced apart from the lower portion 320*b* of the second wall 320 by a first predetermined distance to define a first air flow area 322 therebetween. Similarly, the upper portion 318*a* of the first wall 318 is spaced apart from the upper portion 320*a* of the second wall 320 by a second predetermined distance to define a second air flow area 324 therebetween.

As best shown in FIG. 11, the first predetermined distance is greater than the second predetermined distance. In the present embodiment, it is preferred that the first and second walls 318 and 320 taper inwardly from the lower portions 318*b*, 320*b* of the first and second walls 318 and 320 to the upper portions 318*a*, 320*a* of the first and second walls 318, 320 for allowing air to readily flow therebetween. In other words, the first and second walls 318, 320 telescope inwardly to facilitate air flow therethrough.

In the present embodiment, it is preferred that the first and second predetermined distances as well as the pitch or angle of tapering between the first and second walls 318, 320 be selected such that air efficiently flows through the personal air terminal 310 with sufficient force or pressure to disperse to the surrounding area (in a manner hereinafter described) without creating excessive noise, as is understood by those skilled in the art.

Referring now to FIG. 10, the personal air terminal 310 preferably includes a first side panel 326 and a second side panel 328 integrally connected between and complementing the first and second walls 318, 320 to further form the personal air terminal 310. Like the first and second walls 318, 320, the first and second side panels 326, 328 each have an upper portion 326*a*, 328*a* and a lower portion 326*b*, 328*b*, respectively. The lower portion 326*b* of the first side panel 326 is spaced apart from the lower portion 328*b* of the second side panel 328 by a third predetermined distance to further define the first air flow area 322 therebetween. The upper portion 326*a* of the first side panel 326 is similarly spaced apart from the upper portion 328*a* of the second side panel 328 by a fourth predetermined distance to further define the second air flow area 324 therebetween.

As best shown in FIG. 10, the third predetermined distance is greater than the fourth predetermined distance. In the present embodiment, it is preferred that the first and second side panels 326, 328 taper inwardly from the lower portions 326*b*, 328*b* of the first and second side panels 326, and second side panels 326, 328 for allowing air to readily flow therebetween. That is, it is preferred that the third and fourth predetermined distances as well as the pitch or angle of tapering of the first and second side panels 326, 328 between the first and second side panels 326, 328 be selected such that air efficiently flows through the personal air terminal 310 with sufficient force or pressure to disperse to the surrounding area (in a manner hereinafter described) without creating excessive noise, as is understood by those skilled in the art.

Referring now to FIGS. 10 and 11, the lower portion 318*b*, 320*b* of the first and second walls 318, 320 is in engagement with the floor 312 and complementarily surrounds an opening 330 extending through the floor 312. Similarly, the lower portions 326*b*, 328*b* of the first and second side panels 326, 328 are in engagement with the floor 312 and complementarily surround the opening 330 in the floor 312.

In the present embodiment, it is preferred that the first and second walls 318, 320 and the first and second side panels 326, 328 be integrally connected, for example, by welding, as is understood by those skilled in the art, such that the area defined therebetween is generally rectangular in cross section. However, it is understood by those skilled in the art, that the first and second walls 318, 320 and the first and second side panels 326, 328 could be configured in any geometrical configuration so long as the personal air terminal 310 tapers or telescopes inwardly as it extends upwardly from the floor 312.

The first and second walls 318, 320 and the first and second side panels 326, 328 are preferably constructed of a lightweight high strength preferably metallic material, such as aluminum, which is typically installed in duct work, as is understood by those skilled in the art. However, it is also appreciated by the ordinarily skilled artisan that the first and second walls 318, 320 and the first and second side panels 326, 328 can be constructed of other materials, such as a polymeric material or wood. Furthermore, it is also understood that the first and second walls 318, 320 and the first and second side panels 326, 328 can be of a singular folded structure or include overlapping portions 325, as shown in FIGS. 10 and 11, without departing from the spirit and scope of the invention.

As mentioned previously, a surface 314 of a desk 316 is elevated a predetermined distance from the floor 312. The surface 314 and desk 316 include a complementary opening 332 extending therethrough for receiving the upper portions 318*a*, 320*a*, 326*a*, and 328*a* of the first and second walls 318, 320 and the first and second side panels 326, 328. That is, in the present embodiment, it is preferred that the personal air terminal 310 extend through the desk 316 of a worker (not shown) so that the personal air terminal 310 is positioned proximate the worker to thereby provide the worker with easy and convenient access to the personal air terminal 310 and for directly supplying or directing a flow of conditioned air on or near the worker positioned proximate the desk 316, as described in more detail hereinafter.

It is understood by those skilled in the art, that the present invention is not limited to a personal air terminal 310 extending through an opening in a desk, but is equally applicable to extending through any work surface, such as a work bench, computer table, conference room table, credenza, or other similar furniture or the like. Similarly, it is understood by those skilled in the art, that the personal air terminal 310 need not extend through an opening in furniture, but may be positioned proximate the furniture or in engagement with the furniture. For instance, the personal air terminal 310 can be positioned behind a worker seated at a desk, without departing from the spirit and scope of the invention.

Referring now to FIG. 10, there is provided air outlet means, integral with at least one of the first and second walls 318, 320 and elevated a predetermined distance from the surface 314 for allowing air within the first and second air flow areas 322, 324 to flow therethrough to an area surrounding the personal air terminal 310 and/or directly to or near a person situated proximate thereto.

In the present embodiment, it is preferred that the air outlet means comprise a first air outlet register 334 positioned on said upper portion of one of the first and second walls 318, 320 such that conditioned air is directed through the first air outlet register 334 to impinge directly on or near a person (not shown) proximate the surface 314 without affecting the overall conditioning of the area surrounding the personal air terminal 310.

More particularly, it is preferred that the first air outlet register 334 be positioned between the upper portions 318, 320 of the first and second walls 318, 320, as shown in FIG. 11. In this manner, the person can take advantage of the direct flow of the conditioned air through the first air outlet register 334 for enhanced personal comfort, etc. However, the personal comfort of the person does not result in a significant change in the conditioning of the remaining area surrounding the personal air terminal 310 due to the flow of conditioned air through the second air outlet register 336, described hereinafter, as well as the flow of conditioned air through the first air outlet register 334.

In the present embodiment, it is preferred that the first air outlet register 334 be positioned at a height generally corresponding to the height of the average person's head when seated at the desk 316 for directly supplying a flow of conditioned air to a person seated proximate the desk 316. However, it is understood by those skilled in the art, that the first air outlet register 334 can be positioned anywhere near the top of the personal air terminal 310 or between any of the walls or panels 318, 320, 326, 328, without departing from the spirit and scope of the invention.

In the present embodiment, it is preferred that the upper portions 318*a*, 320*a*, 326*a*, 328*a* of the first and second wall panels 318, 320 and first and second side panels 326, 328 be angled toward the person sitting at the desk 316 to provide the person with a direct supply of conditioned air, as shown in FIG. 11. However, it is understood by the ordinarily skilled artisan that the upper portions 318*a*, 320*a*, 326*a*, 328*a* could be positioned at any angle with respect to the surface 314, including perpendicular or parallel, without departing from the spirit and scope of the invention.

It is also preferred that the air outlet means further comprise a second air outlet register 336 positioned in the second wall 320 between the first air outlet register 334 and the surface 314 for providing a flow of conditioned air for conditioning the area generally surrounding the personal air terminal 310. However, it is understood by those skilled in the art, that the second air outlet register 336 can be positioned anywhere along the second wall 320. For instance, the second air outlet register 336 could be directly aligned with the surface 314 such that air flows both above the surface 314 and below the surface 314.

While it is preferred that the second air outlet register 336 be located in a wall or panel of the personal air terminal which faces away from the person seated at the desk 316, it is understood by those skilled in the art, that the second air outlet register 336 can be positioned in any of the first or second walls 318, 320 or first and second side panels 316, 328 without departing from the spirit and scope of the invention.

As shown in FIG. 10, in the present embodiment, it is preferred that the first and second air outlet registers 334, 336 extend generally the entire width W of the personal air terminal 310 for allowing greater volumes of air to flow therethrough without creating excessive background noise. However, it is understood by those skilled in the art, that the first and second air outlet registers 334, 336 could be downsized to a smaller length or could include a series of registers spaced across the width W of the personal air terminal 310 without departing from the spirit and scope of the invention.

In the present embodiment, it is preferred that the first and second air outlet registers 334, 336 include at least several individual louvers 338 and damping means (not shown) for providing both volumetric and directional control of the air flowing therethrough in a manner similar to that used for ventilating passenger vehicles. More particularly, it is preferred that the first and second air outlet registers 334, 336 be adjustable to direct air flow both vertically and horizontally. Additionally, it is preferred that the first and second air outlet registers 334, 336 each be volumetrically controlled between a fully opened and a fully closed condition. However, it is understood by those skilled in the art, that other types of registers may be used without departing from the spirit and scope of the invention. For instance, the first air outlet register 334 could be a standard, non-adjustable outlet or an outlet having only directional control. The air outlet means are preferably secured to the first and second side walls 318, 320 by using standard hardware or the like.

It is appreciated by those skilled in the art, that the present invention is not limited to any specific size, type or number of air outlet registers. Specifically, it is preferred that the number and type of registers be selected to conform to the type of room in which the personal air terminal 310 is positioned. For instance, if the personal air terminal is positioned within a large desk or table top which is shared by two persons, it may be preferred to place an air outlet register in both of the side walls 318, 320 for directly supplying a flow of conditioned air to either person.

Referring now to FIG. 11, a baffle means is positioned between the first and second air outlet registers 334, 336 and between the first and second walls 318, 320 for controlling the respective flow of conditioned air through the first and second air outlet registers 334, 336. In the present embodiment, it is preferred that the baffle means comprise a pivotable or moveable damper 340 positioned proximate the second air outlet register 336 and extending along the entire width W of the personal air terminal 310 for controlling the flow of air through each respective register, as is understood by those skilled in the art. However, it also understood by those skilled in the art, that other means can be used for controlling the flow of air through the first and second air outlet registers 334, 336, such as a static damper (not shown).

In the present embodiment, the damper 340 includes control means comprising an adjustment handle 342 for allowing the position of the damper 340 to be selectively or individually adjusted by persons proximate the personal air terminal 310 for personally controlling the flow of air through the first air outlet register 334. It is appreciated by those skilled in the art, that the position of the damper 340 and/or the position of the first and second air outlet registers 334, 336 does not affect the overall conditioning of the area surrounding the personal air terminal 310 because the flow of conditioned air to the surrounding area remains generally constant.

Thus, for example, if a person seated near the personal air terminal 310 was to adjust the damper 340 so that no conditioned air was to flow through the first air outlet register 334, all of the conditioned air flowing through the air flow areas 322, 324 passes through the second air outlet register 336 to condition the air in the area surrounding the personal air terminal 310. Similarly, if the damper 340 is adjusted so that some conditioned air flows through the first air outlet register 334 for impingement on the person, the remainder of the conditioned air flowing through the air flow areas 322, 324 passes through the second air outlet register 336 resulting in the substantially the same volume of conditioned air flowing through the first and second air outlet registers 334, 336 and the same overall conditioning in the area surrounding the personal air terminal 310. As shown in FIG. 11, a stop member 344 within the air flow area 324 and secured to the first side panel 326, prevents the damper 340 from completely blocking air flow through the second air outlet register 336.

In the present embodiment, it is preferred that the damper 340 be directly connected (not shown) to one of the first or second side walls 218, 220 for support and access. However, it is understood by those skilled in the art, that the damper 340 could be supported by the first and second side panels 326, 328 or other means without departing from the spirit and scope of the invention.

As mentioned previously, the person air terminal 310 is sized to complementarily surround the opening 330 for allowing conditioned air to flow from the second side 312*b* of the floor 312 into the first air flow area 322 whereby air flows from the second side 312*b* of the floor 312 into the first and second air flow areas 322, 324 and through the first and second air outlet registers 334, 336 to the surrounding area. In the present embodiment, it is preferred that a plenum or plenum chamber 346 be positioned between the second side 312*b* of the floor 312 and a lower floor 348, similar to that described above in connection with FIGS. 1-9.

As schematically shown in FIGS. 10 and 11, air moving means is provided for moving conditioned air from a plenum 346 into and through the first and second air flow areas 322, 324. Preferably, the air moving means is positioned on the second side 312*b* of the floor 312. However, it is understood by those skilled in the art, that the air moving means may be installed above the floor 312 within the first air flow area 322.

In the present embodiment, it is preferred that the air moving means be comprised of a blower or fan unit 350 for moving air within the plenum 346 through the opening 330 into the air flow areas 322, 324 and through the first and second air outlet registers 334, 336 to the surrounding area. The unit 350 is preferably manually controlled by a control unit (not shown) positioned proximate the personal air terminal 310. However, it is understood by the ordinarily skilled artisan, that the unit 350 can be automatically controlled by a thermostat (not shown) or other temperature or air flow regulating means, without departing from the spirit and scope of the invention.

In the present embodiment, the blower or fan unit 350 has an output opening (not shown) which generally corresponds to the size and shape of the opening 330. This is necessary to overcome the resistance of the first and second walls 318, 320 and the first and second side panels 326, 328 to assure sufficient air flow through the first and second air flow areas 322, 324 into the surrounding area. Since the first and second walls 318, 320 and the first and second side panels 326, 328 are telescoped or tapered inwardly, the air flowing therethrough encounters a lesser amount of resistance as compared to non-tapered air terminals and thereby reduces the amount of power necessary to drive the fan unit 350.

Preferably, the personal air terminal 310 uses a single blower or fan unit 350. However, it is understood by those skilled in the art, that a plurality of spaced units could be used to obtain the requisite air flow.

While in the present embodiment, it is preferred that an air moving means be provided for moving conditioned air from a plenum, it is understood by those skilled in the art, that the present invention is equally applicable to a forced air system such that the personal air terminal 310 is directly connected to duct work or the like which is supplied with pressurized conditioned air from a furnace or the like.

From the foregoing description, it can be seen that the present invention comprises a personalized air conditioning system which is simple in construction to effect substantial savings in initial operating and maintenance costs, is highly versatile for use with the changing work place requirements, and enhances the comfort of individuals having different comfort requirements, for increased work place efficiency. It will be appreciated by those skilled in the art that changes could be made to the embodiments described above without departing from the broad inventive concept thereof. It is understood, therefore, that this invention is not limited to the particular embodiments disclosed, but it is intended to cover all modifications which are within the scope and spirit of the invention as defined by the appended claims.

We claim:

1. A personal air terminal extending from a mounting member for supplying conditioned air to an area, the mounting member having a first side and a second side, said personal air terminal comprising:

a first wall integrally connected to a second wall to form the personal air terminal, said first and second walls each having upper and lower portions, said lower portion of said first wall being spaced apart from said lower portion of said second wall by a first predetermined distance to define a first air flow area therebetween, said upper portion of said first wall being spaced apart from said upper portion of said second wall by a second predetermined distance to define a second air flow area therebetween, said first predetermined distance being greater than said second predetermined distance, said first and second walls tapering inwardly from said lower portions of said first and second walls to said upper portions of said first and second walls for allowing air to readily flow therebetween, said lower portions of said first and second walls being in engagement with said mounting member and surrounding an opening in said mounting member;

air outlet means integral with one of said first or second walls and elevated a predetermined distance from said first side of said mounting member for allowing air flowing through said first and second air flow areas to flow therethrough to an area surrounding said personal air terminal; and air moving means for moving conditioned air from said second side of said mounting member into said first and second air flow areas whereby air flows from said second side of said mounting member through said opening into said first and second flow areas and through said air outlet means to said surrounding area.

2. The personal air terminal as recited in claim 1, wherein said air moving means is positioned on the second side of said mounting member.

3. The personal air terminal as recited in claim 1, wherein said outlet means comprises a first air outlet register positioned on said upper portion of one of said first and second walls whereby conditioned air is directed through said first air outlet register to impinge directly on or near a person proximate the personal air terminal without affecting the overall conditioning of the area surrounding the personal air terminal.

4. The personal air terminal as recited in claim 3, wherein said air outlet means further comprises a second air outlet register positioned in one of said first and second walls between said first air outlet register and said first side of said mounting member for providing a flow of conditioned air for conditioning the area surrounding the personal air terminal.

5. The personal air terminal as recited in claim 4, further including baffle means positioned between said first and second air outlet registers for controlling the respective flow of air through said first and second air outlet registers.

6. The personal air terminal as recited in claim 1, further including a first side panel and a second side panel integrally connected between and complementing said first and second walls to further form the personal air terminal, said first and second side panels each having an upper portion and a lower portion, said lower portion of said first side panel being spaced apart from said lower portion of said second side panel by a third predetermined distance to further define said first air flow area therebetween, said upper portion of said first side panel being spaced apart from said upper portion of said second side panel by a fourth predetermined distance to further define said second air flow area therebetween, said third predetermined distance being greater than said fourth predetermined distance, said first and second side panels tapering inwardly from said lower portions of said first and second side panels to said upper portions of said first and second side panels for allowing air to readily flow therebetween, said lower portions of said first and second side panels being in engagement with said mounting member and surrounding said opening in said mounting member.

7. A personal air terminal extending upwardly from a floor through a surface for supplying conditioned air to an area, the floor having a first side and a second side, said personal air terminal comprising:

a first wall integrally connected to a second wall to form the personal air terminal, said first and second walls each having upper and lower portions, said lower portion of said first wall being spaced apart from said lower portion of said second wall by a first predetermined distance to define a first air flow area therebetween, said upper portion of said first wall being spaced apart from said upper portion of said second wall by a second predetermined distance to define a second air flow area therebetween, said first predetermined distance being greater than said second predetermined distance, said first and second walls tapering inwardly from said lower portions of said first and second walls to said upper portions of said first and second walls for allowing air to readily flow therebetween, said lower portions of said first and second walls being in engagement with said floor and surrounding an opening in said floor;

air outlet means integral with one of said first or second walls and elevated a predetermined distance from said first side of said floor for allowing air flowing through said first and second air flow areas to flow therethrough to an area surrounding said personal air terminal; and air moving means for moving conditioned air from said second side of said floor into said first and second air flow areas whereby air flows from said second side of said floor through said opening into said first and second flow areas and through said air outlet means to said surrounding area.

8. The personal air terminal as recited in claim 7, wherein said air moving means is positioned on the second side of said floor.

9. The personal air terminal as recited in claim 7, wherein said outlet means comprises a first air outlet register positioned on said upper portion of one of said first and second walls whereby conditioned air is directed through said first air outlet register to impinge directly on or near a person proximate the personal air terminal without affecting the overall conditioning of the area surrounding the personal air terminal.

10. The personal air terminal as recited in claim 9, wherein said air outlet means further comprises a second air outlet register positioned in one of said first and second walls between said first air outlet register and said floor for providing a flow of conditioned air for conditioning the area surrounding the personal air terminal.

11. The personal air terminal as recited in claim 10, further including baffle means positioned between said first and second air outlet registers for controlling the respective flow of air through said first and second air outlet registers.

12. The personal air terminal as recited in claim 7, further including a first side panel and a second side panel integrally connected between and complementing said first and second walls to further form the personal air terminal, said first and second side panels each having an upper portion and a lower portion, said lower portion of said first side panel being spaced apart from said lower portion of said second side panel by a third predetermined distance to further define said first air flow area therebetween, said upper portion of said first side panel being spaced apart from said upper portion of said second side panel by a fourth predetermined distance to further define said second air flow area therebetween, said third predetermined distance being greater than said fourth predetermined distance, said first and second side panels tapering inwardly from said lower portions of said first and second side panels to said upper portions of said first and second side panels for allowing air to readily flow therebetween, said lower portions of said first and second side panels being in engagement with said floor and surrounding said opening in said floor.

13. A personal air terminal extending upwardly from a floor through a surface for supplying conditioned air to an area, the floor having a first side and a second side, said personal air terminal comprising:

a first wall integrally connected to a second wall to form the air terminal, said first and second walls each having upper and lower portions, said lower portion of said first wall being spaced apart from said lower portion of said second wall by a first predetermined distance to define a first air flow area therebetween, said upper portion of said first wall being spaced apart from said upper portion of said second wall by a second predetermined distance to define a second air flow area therebetween, said first predetermined distance being greater than said second predetermined distance, said first and second walls tapering inwardly from said lower portions of said first and second walls to said upper portions of said first and second walls for allowing air to readily flow therebetween, said lower portions of said first and second walls being in engagement with said floor and surrounding an opening in said floor;

a surface elevated a predetermined distance from said floor, said surface including a complementary opening therethrough for receiving said upper portions of said first and second walls therethrough;

air outlet means integral with one of said first and second walls and elevated a predetermined distance from said surface for allowing air within said air flow areas to flow therethrough to an area surrounding said personal air terminal; and air moving means for moving conditioned air from said second side of said floor into said air flow areas whereby air flows from the second side of said floor through said opening into said air flow areas and through said air outlet means to said surrounding area.

14. The personal air terminal as recited in claim 13, wherein said air moving means is positioned on the second side of said floor.

15. The personal air terminal as recited in claim 13, wherein said outlet means comprises a first air outlet register positioned on said upper portion of one of said first and second walls whereby conditioned air is directed through said second air outlet register to impinge directly on or near a person proximate the surface without affecting the overall conditioning of the area surrounding the personal air terminal.

16. The personal air terminal as recited in claim 15, wherein said air outlet means further comprises a second air outlet register positioned in one of said first or second walls between said first air outlet register and said surface for providing a flow of conditioned air for conditioning the area surrounding the personal air terminal.

17. The personal air terminal as recited in claim 16, further including baffle means positioned between said first and second air outlet registers for controlling the respective flow of air through said first and second air outlet registers.

18. The personal air terminal as recited in claim 13, further including a first side panel and a second side panel integrally connected between and complementing said first and second walls to further form the personal air terminal, said first and second side panels each having an upper portion and a lower portion, said lower portion of said first side panel being spaced apart from said lower portion of said second side panel by a third predetermined distance to further define said first air flow area therebetween, said upper portion of said first side panel being spaced apart from said upper portion of said second side panel by a fourth predetermined distance to further define said second air flow area therebetween, said third predetermined distance being greater than said fourth predetermined distance, said first and second side panels tapering inwardly from said lower portions of said first and second side panels to said upper portions of said first and second side panels for allowing air to readily flow therebetween, said lower portions of said first and second side panels being in engagement with said floor and surrounding said opening in said floor.

* * * * *